235-404 SR
3/2/82 XR 4,317,650

United States Patent [19] [11] 4,317,650
Lee et al. [45] Mar. 2, 1982

[54] WEAPON TRAINING SYSTEMS

[75] Inventors: Derek J. Lee, Farnborough; James L. C. Livingstone, Cove, both of England

[73] Assignee: The Solartron Electronic Group Limited, Farnborough, England

[21] Appl. No.: 74,207

[22] Filed: Sep. 10, 1979

[30] Foreign Application Priority Data

Sep. 13, 1978 [GB] United Kingdom ..... 36659/78

[51] Int. Cl.[3] ..... F41G 3/26
[52] U.S. Cl. ..... 434/16; 235/404
[58] Field of Search ..... 35/25; 331/78; 235/400, 235/404, 405, 407, 411, 412, 413, 414, 415, 416, 417; 364/423, 516, 517, 801; 434/16

[56] References Cited

U.S. PATENT DOCUMENTS

| | | | |
|---|---|---|---|
| 3,588,108 | 6/1971 | Ormiston | 35/25 X |
| 3,604,897 | 9/1971 | McAdam, Jr. | 235/404 |
| 3,810,039 | 5/1974 | Fein | 331/78 |
| 3,877,157 | 8/1973 | Ashford et al. | 35/25 |

FOREIGN PATENT DOCUMENTS

| | | | |
|---|---|---|---|
| 1937412 | 7/1973 | Fed. Rep. of Germany | 235/407 |
| 2149701 | 7/1975 | Fed. Rep. of Germany | 35/25 |
| 1228143 | 4/1971 | United Kingdom | 35/25 |
| 1228144 | 4/1971 | United Kingdom | 35/25 |
| 1298332 | 11/1972 | United Kingdom | 35/25 |
| 1451192 | 9/1976 | United Kingdom | 35/25 |

*Primary Examiner*—William H. Grieb
*Attorney, Agent, or Firm*—Dale V. Gaudier; Mikio Ishimaru

[57] ABSTRACT

In order to incorporate minor perturbations in the simulated operation of a weapon (to simulate dispersion between batches of ammunition or individual rounds, and/or the effects of changing environmental phenomena), a variable is generated at a rate related to the type of ammunition to be simulated. For ammunition exhibiting a high degree of dispersion between rounds, the variable changes rapidly and an accurately-aimed shot is deemed a hit only if the value of the variable at that instant is less than the predetermined probability of a hit with that ammunition. In the case of ammunition exhibiting some consistency between rounds but not between batches, the variable changes slowly, and its value controls the extent of a displacement applied to a laser projector before the projector is energised and scanned for a hit/miss determination.

20 Claims, 7 Drawing Figures

20
TO
24
36
TO
46
56
LASER DRIVE
50
SCAN CONTROLLER
OFFSETS
54
'RANGE'
Rx
RANGE
SEQUENCE CONTROLLER
'FIRE'
52
60
COUNTER
STORE
62
64
HIT/MISS INDICATOR
58

TO
20
24
36
TO
46
50
OFFSETS
LASER DRIVE
56
SCAN CONTROLLER
52
54
RX
RANGE
SEQUENCE CONTROLLER
'RANGE'
'FIRE'
COUNTER
66
68a
H
V
68e
STORE
72
70a
70e
HIT/MISS INDICATOR
58

WEAPON TRAINING SYSTEMS

This invention relates to weapon training systems.

It is well known to provide weapon training systems for simulating the effects of firing guns at targets and for assessing accuracy of aim, without using live ammunition: such systems are described, for example, in our British Patent Nos. 1,228,143, 1,228,144 and 1,451,192. In these systems a weapon is first aimed directly at a target, and a laser mounted on the weapon is used to measure the range of the target. When manually derived offsets in elevation and azimuth have been applied to the weapon, the correct offsets derived by the training system are applied, but in the reverse sense, to the orientation of the laser: thus, if the weapon offsets have been correctly derived and applied, they will be exactly compensated by the offsets applied to the laser, so the laser will once more be oriented along a datum direction, directly towards the target. When the laser is energised, a detector on the target receives radiation from the laser, and a 'hit' is registered. The beam can be scanned about the datum direction to detect a near-miss and the directional error (up, down, left or right) involved.

In known systems of this kind, a 'hit' will be registered whenever the weapon is correctly aimed, whereas in reality a hit is sometimes not obtained even when the weapon has apparently been correctly aimed. This is because of variations between rounds and batches of ammunition and changes in wind conditions, for example, which are unknown to the person aiming the weapon, and for which compensation cannot therefore be made in the process of aiming the weapon.

It is an object of this invention to provide a weapon training system which provides a more realistic simulation of the effects of such unknown quantities on the aiming and firing of a weapon.

According to a first aspect of this invention a method of incorporating a probability factor in an assessment of the accuracy of aim of a weapon comprises the steps of generating a variable whose value changes at a rate related to a characteristic of ammunition the use of which is to be simulated, and modifying each assessment of accuracy in accordance with the current value of said variable.

In one version, the method involves generating said variable such that its value varies through a range including the minimum and maximum values of the probability factor in a pseudo-random manner relative to the time interval between successive aimings of the weapon; determining whether the weapon has been substantially optimally aimed in relation to a target; comparing the value of said variable with said probability factor; and assessing the aim as being accurate only if the weapon has been substantially optimally aimed and said value is less than said factor.

This method is particularly advantageous for use in relation to ammunition which exhibits unpredictable changes in dispersion of fall of shot between successive rounds.

The probability factor may be calculated in advance from the known characteristics of the ammunition, for different types of target and different ranges, the appropriate value being selected for comparison with the value of said variable in dependence upon the type and range of the target.

The variable may be generated by incrementing and decrementing a counter at intervals much less than the interval between successive aimings of the weapon, the amount of each decrement being a non-integral multiple of the amount of each increment.

In another version, for use in an assessment of the accuracy of aim involving scanning a beam of electromagnetic radiation about a datum direction corresponding to optimum aim, the method involves generating said variable such that its value varies gradually with time; and displacing the orientation of said beam from said datum direction in accordance with the value of the variable before said scanning is effected.

This method is useful in relation to ammunition which exhibits some consistency in characteristics as between successive rounds, but a longer term inconsistency, for example as between different batches of ammunition. It also provides some simulation of the effects of environmental phenomena, such as wind conditions, which may change slowly.

Preferably the variable varies in a manner that is step wise linear with time, successive intervals between steps being unequal.

The variable may be generated by incrementing a counter up to a predetermined full-house count, and varying the variable by a fixed amount when said count reaches predetermined trigger values which sub-divide the full-house count unequally.

According to a second aspect of this invention there is provided a weapon training system for incorporating a probability factor in an assessment of the accuracy of aim of a weapon, comprising means arranged to generate a variable whose value changes at a rate related to a characteristic of ammunition the use of which is to be simulated, and means arranged to modify each assessment of accuracy in accordance with the current value of said variable.

In one version, the system has said generating means arranged to generate said variable such that its value varies through a range including the minimum and maximum values of the probability factor in a pseudo-random manner relative to the time interval between successive aimings of the weapon; means arranged to determine whether the weapon has been substantially optimally aimed in relation to a target; and said modifying means arranged to compare the value of said variable with said probability factor such that the aim is assessed as being accurate only if the weapon has been substantially optimally aimed and the said value is less than said factor.

In another version, for use in conjunction with means for scanning a beam of electromagnetic radiation about a datum direction corresponding to optimum aim, the system has said generating means arranged to generate said variable such that its value varies gradually with time; and the scanning means is responsive to the generating means to displace the orientation of said beam from said datum direction in accordance with the value of the variable before said scanning is effected.

Methods and apparatus in accordance with this invention will now be described, by way of example, with reference to the accompanying drawings, in which.

Figure 1:
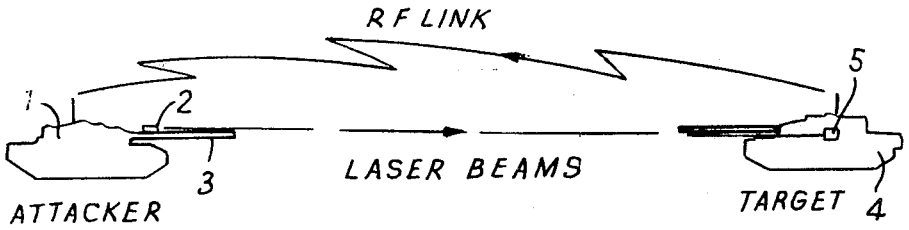
FIG. 1 depicts an attacking tank and a target tank.

The methods and apparatus to be described are for use in equipment for training tank crews in gunnery and firing procedures without the expense and danger of firing live ammunition. As shown in FIG. 1, an attacking tank 1, with a projector 2 mounted on a main gun 3, is engaging a target tank 4 carrying a detector 5. Simulated firing of the main gun 3 causes a pulsed beam or beams of radiation from a laser source within the projector 2 to scan in relation to the axis of the main gun 3, to detect a 'hit' or a 'miss'. When a beam impinges on the detector 5, a signal is transmitted by an r.f. transmitter in the target tank 4 to a receiver in the attacking tank 1.

Figure 2:
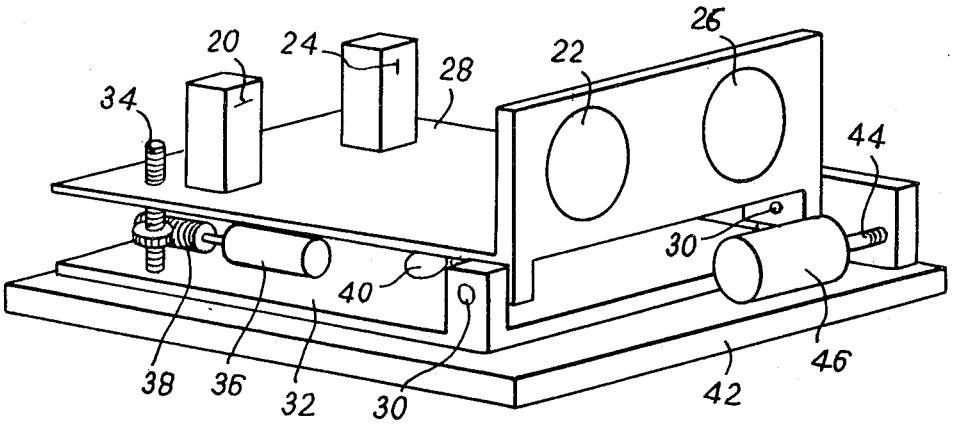
FIG. 2 shows diagrammatically a source of two beams of radiation and means for steering these beams.

The positioning and scanning relative to the main gun 3 of the laser beam or beams can be effected by steering the beams in azimuth and in elevation, and an arrangement for accomplishing this is shown diagrammatically in FIG. 2.

Referring to FIG. 2, a first beam, narrow in elevation, is formed by a gallium-arsenide (GaAs) laser diode 20, mounted with its junction lying in the horizontal plane, and a collimating lens 22. A second beam, narrow in azimuth, is formed by a GaAs laser diode 24, mounted with its junction lying in the vertical plane, and a collimating lens 26.

Lasers 20 and 24 and lenses 22 and 26 are mounted on a common frame 28 which is pivotable about an axis 30 in relation to a subframe 32. A screw 34 is screw-threadedly engaged in the frame 28, and is free to rotate in, but not to move axially with respect to, the subframe 32. The frame 28 may be tilted about the axis 30 with respect to the subframe 32, by operation of a geared electric motor 36 which drives the screw 34 through a worm gear 38.

The subframe 32 may also be rotated about a bearing 40 with respect to a base 42, by means of a screw 44 engaged in a screwed hole in the subframe 32 and driven by a geared electric motor 46. The base 42 is, in operation, positively located with respect to the boresight of the main gun 3 on the attacking tank 1. The geared electric motors 36 and 46 are stepping motors provided with control circuits (for example, as described in British Pat. No. 1,298,332) which enable the number of steps or revolutions of the motors, and therefore the angular position of the frame 28 about the axis 30 and of the subframe 32 about the bearing 40, to be expressed in terms of the number of pulses of energising current supplied to the motors 36 and 46 to move them from respective datum or zero positions.

Figure 3:
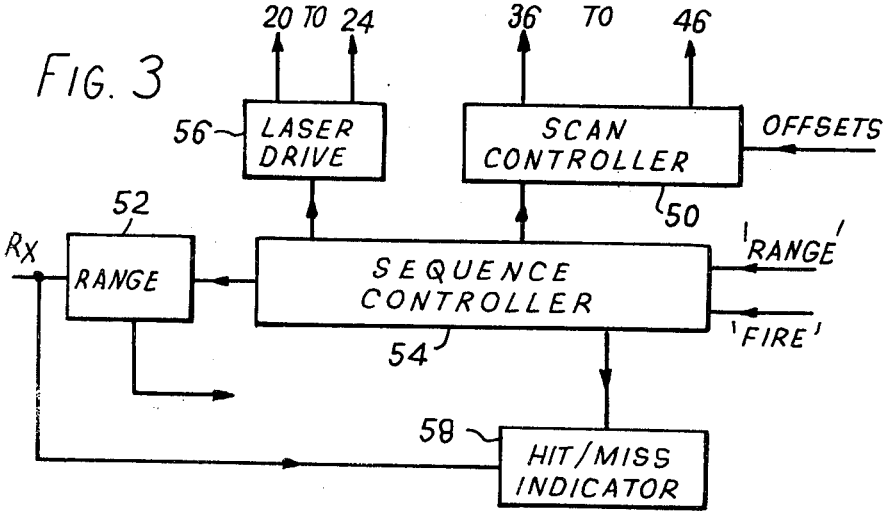
FIG. 3 is a schematic diagram of a weapon training system.

Full details of the circuitry and operation of a weapon training system such as that shown in FIG. 1 are contained in our British Pat. Nos. 1,228,143, 1,228,144 and 1,451,192, and the sequence of steps in the simulation of a battle engagement need only be summarised here, with reference to FIG. 3.

After the tank commander has identified a target and the gunner has laid the main boresight on the target, the range of the target is obtained by energising the laser diodes 20 and 24. The orientation of the laser beams is controlled by a scan controller 50 initially to be aligned with the bore of the gun 3, so the detector 5 on the target tank 4 (FIG. 1) will receive the laser beams and return corresponding r.f. signals, enabling a range circuit 52 associated with the projector 2 to derive the range by measurement of the elapsed time between emission of a laser pulse and receipt of the corresponding r.f. signal from the target tank 4.

The tank commander or a fire control system in the attacking tank 1 calculates ballistic offsets for the gun 3 from the range (which may be manually estimated, or measured as above) and from such other information as windspeed; if there is relative movement between the tanks 1 and 4, tracking offsets would also be calculated on the basis of tracking of the target tank 4 by the gunner using the main boresight.

The calculated offsets (elevation and aim-off) are applied to move the gun 3 (carrying the projector 2 with it), and the gun is 'fired'. Thereupon, a sequence controller 54 causes the scan controller 52 to supply appropriate numbers of pulses of energising current to the stepping motors 36 and 46 to deflect the orientation of the laser beams of the projector 2 relative to the gun 3 through the correct offsets (calculated from the accurately measured range) but in the opposite sense to the offsets applied to the gun 3. Thus, if the gun 3 has been optimally aimed, the offsets for the gun 3 and the projector 2 will cancel each other, and the projector 2 will be directed at the target tank 4 again, so when the laser diodes are energised via a drive circuit 56 and scanned (by the supply of further energising pulses to the stepping motors 36 and 46), a 'hit' will be registered by a hit/miss indicator 58 responsive to the r.f. receiver in the attacking tank 1.

Figure 4:
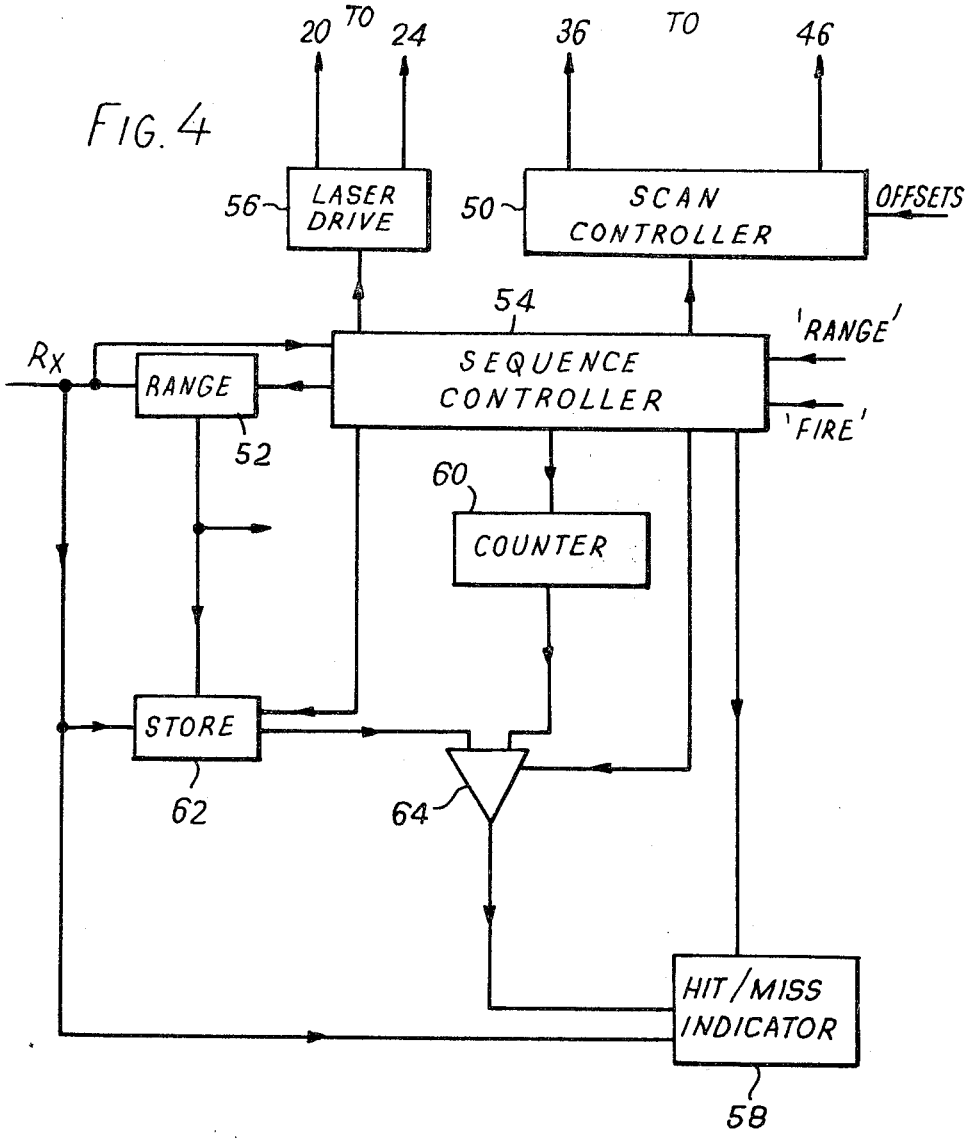
FIG. 4 is a schematic diagram of one form of the apparatus incorporated in the system of FIG. 3.
Figure 6:
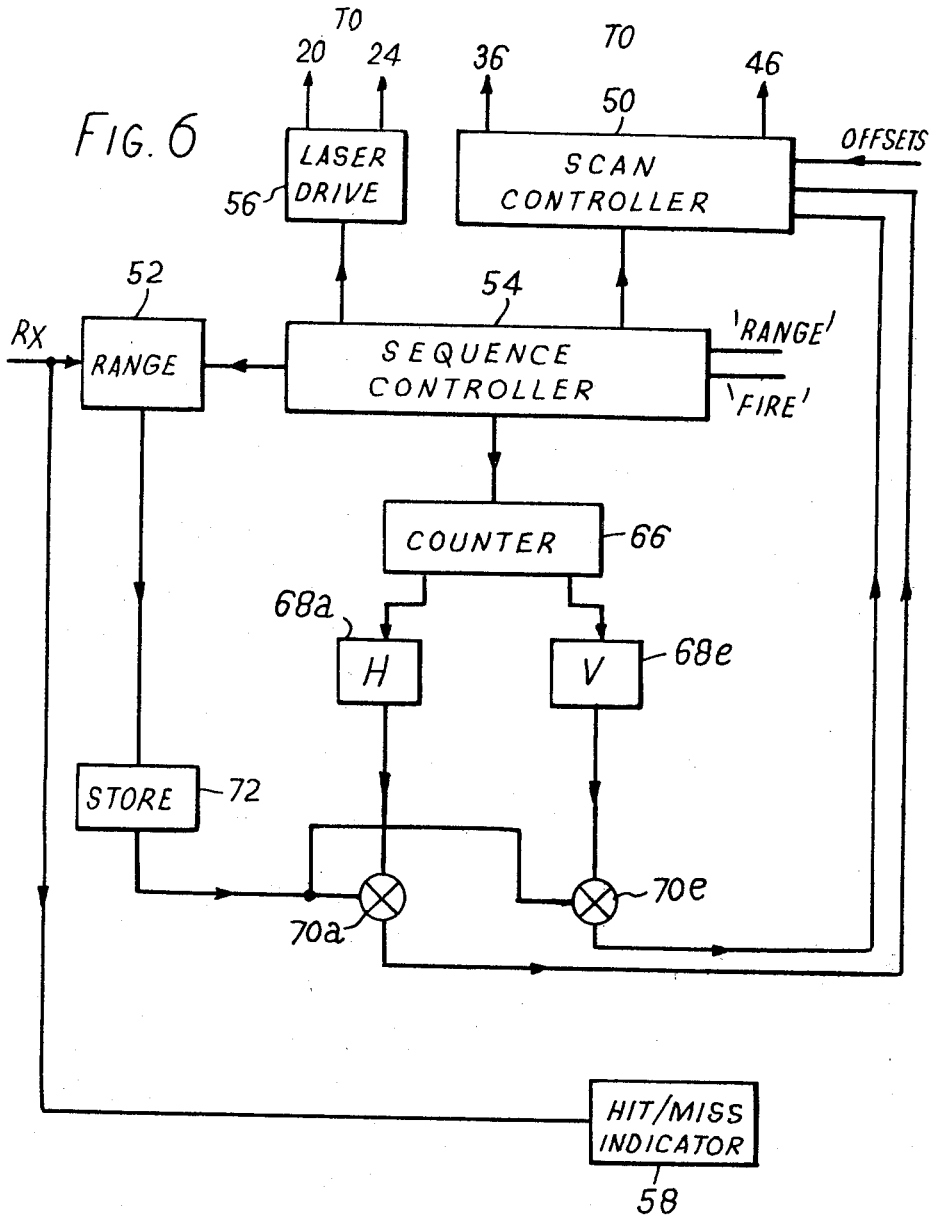
FIG. 6 is a schematic diagram of another form of the apparatus incorporated in the system of FIG. 3.
Figure 7:
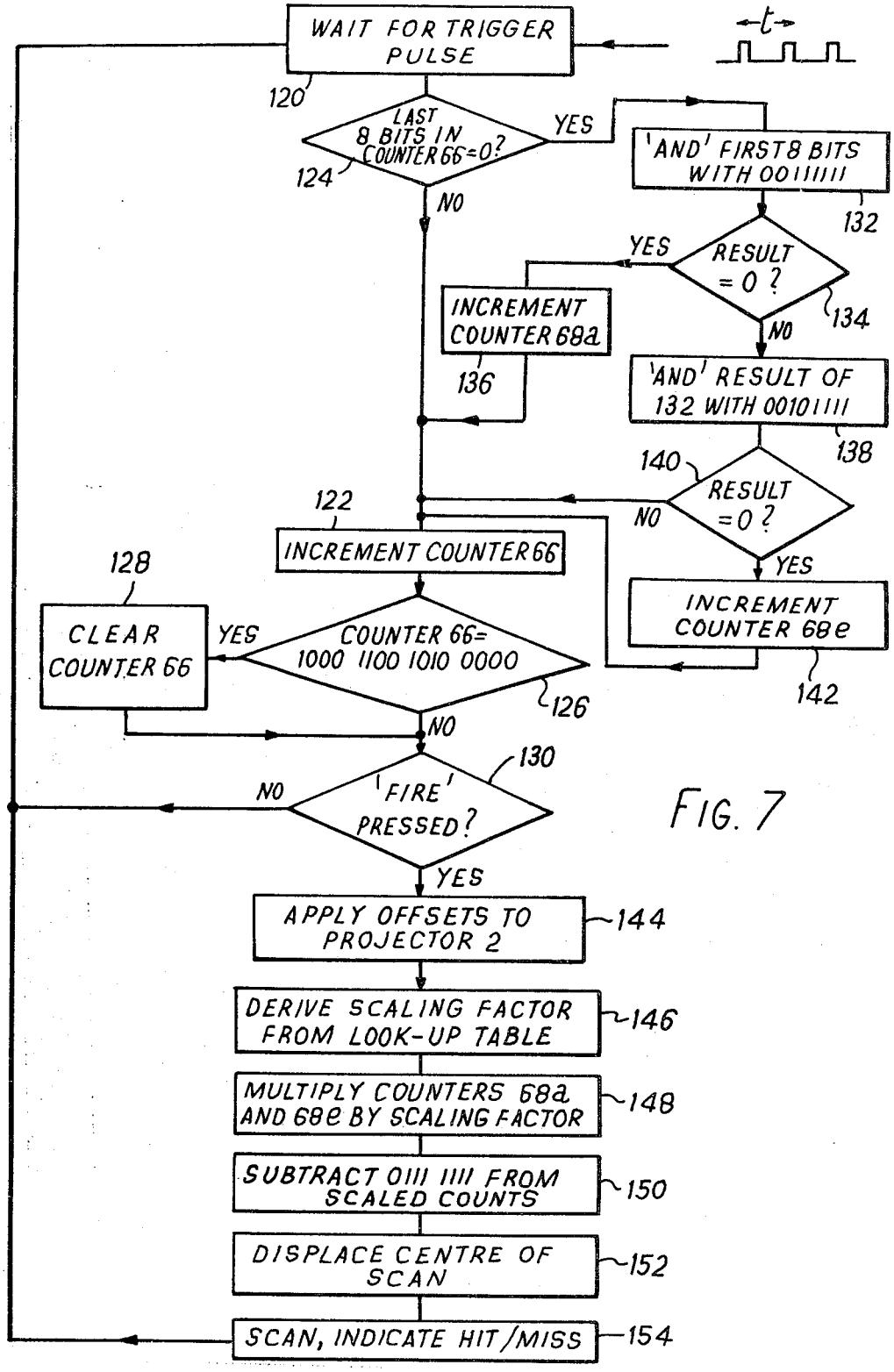
FIG. 7 is a flow chart depicting the operation of the apparatus of FIG. 6.

As noted earlier, known weapon training systems which operate as described above will indicate a 'hit' whenever the gun 3 is correctly aimed, whereas in reality some proportion of accurately-aimed shots result in misses, for example because of unpredictable variations as between shells or batches of shells. FIGS. 4 and 6 illustrate in schematic form the system of FIG. 3 modified by the incorporation of apparatus for simulating the effects of such unpredictable variations, and FIGS. 5 and 7 show the respective methods of operation.

Figure 5:
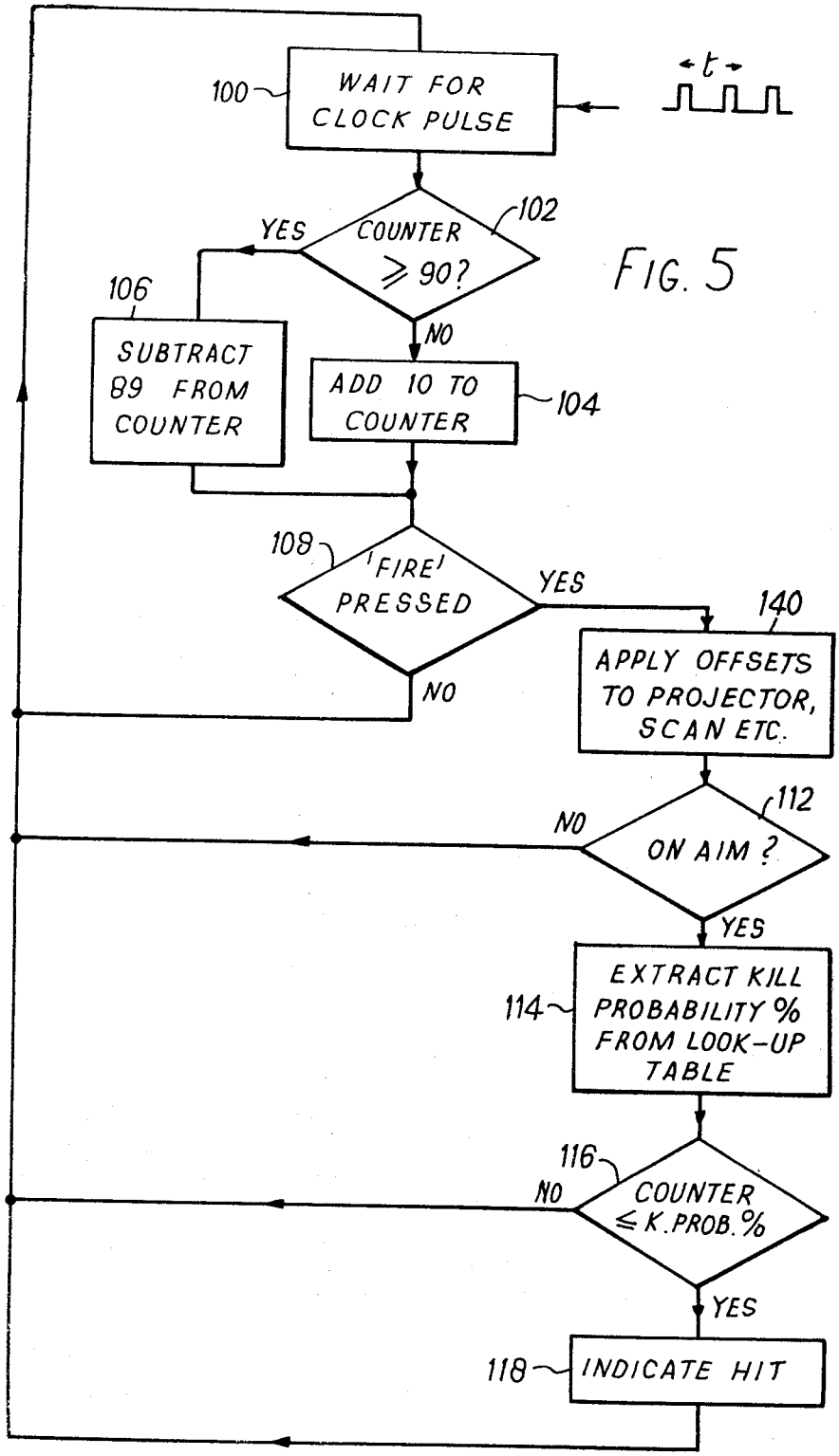
FIG. 5 is a flow chart depicting the operation of the apparatus of FIG. 4.

Referring to FIGS. 4 and 5 (which are suitable for use in connection with ammunition exhibiting variations from one shell to the next), the sequence controller 54 has associated with it, in addition to the circuits described above, a counter 60, a store 62 and a comparator 64 which receives the output signals from the counter 60 and the store 62. The output of the comparator 64 is supplied with that of the r.f. receiver to the hit/miss indicator 58.

As shown in FIG. 5, the sequence controller 54 is arranged to respond to trigger signals at intervals t (step 100) to test the count in the counter 60 at step 102 to determine if it equals or exceeds 90. If it does not, the count is incremented by 10 at step 104, whereas if it does the count is decremented by 89 at step 106. If the gun 3 has not been 'fired', as detected at step 108, the sequence controller 54 returns to step 100, to wait for the next trigger signal (the duration of t is typically a few milliseconds).

When the gun 3 is 'fired' and the sequence controller 54 next reaches step 108, it advances to step 110 to operate the scan controller 50 and the laser drive circuit 56 as described above to test whether the gun has been optimally aimed. If the result is negative, as determined at step 112, the sequence controller 54 returns to step 100. For a positive result, the controller 54 moves to step 114 where it triggers the store 62 to supply the kill probability figure as a percentage (0% indicating no chance of a hit and 100% indicating a hit every time the gun 3 is optimally aimed).

The store 62 derives the probability from a look-up table containing pre-calculated figures, by reference to the range of the target as indicated by the range circuit 52 and taking into account the nature (for example, degree of armouring) of the target. This latter information may be supplied to the store 62 by the target in any convenient manner via the r.f. link.

The kill probability figure is then compared at step 116 with the count in the counter 60, by the comparator 64, which only enables the hit/miss indicator 58 to indicate a hit at step 118 if the count is not greater than the kill probability figure. Whatever the outcome, the apparatus then returns to step 100.

The effect of incrementing the counter 60 in steps of 10 is to cycle rapidly through the range of possible kill probability figures, and decrementing by 89 (a non-integral multiple of 10) ensures that the count nonetheless passes through every possible probability value. Since the counter 60 cycles through these values very quickly in relation to the time taken to lay and fire the main gun 3, the particular count in the counter 60 when step 116 is reached is effectively random. Over many shots, the counter 60 would provide every possible value for comparison with a given kill probability figure, resulting in indications of a hit for all values less than or equal to the kill probability figure, and of a miss for all remaining values. Thus, in the long term, the percentage of shots resulting in indication of a hit for optimum aim of the gun 3 equals the kill probability figure.

In the case of ammunition which exhibits some consistency of characteristics within each batch, but unpredictable variations from one batch to the next, the apparatus shown in FIG. 6 can be used.

Referring to FIG. 6, the sequence controller is coupled to a 16-bit binary counter 66 which supplies clock signals at specific counts to each of two 8-bit counters 68*a* and 68*e*. The counts in these counters 68 are supplied to respective multipliers 70*a* and 70*e* which also receive the output signal from a store 72 responsive to the range signal from the range circuit 52. The outputs from the multipliers 70 are fed to the scan controller 50.

In operation, the sequence controller waits at step 120 for a trigger signal which occurs at intervals t (equal to $1\frac{2}{3}$ milliseconds). The least significant 8 digits of the count in the counter 66 are then examined at step 124 to determine if they are all 0. If not, the count is incremented by 1 at step 122 and then further tested at step 126 for equality with 1000 1100 1010 0000 (equal to decimal 36000), at which value the count is reset to zero in step 128. Whether or not resetting occurs, the apparatus then checks for 'firing' of the gun 3 at step 130, and, if the gun 3 has not been fired, returns to step 120.

It can be seen that the counter is reset at intervals of $36000 \times t$, that is every minute.

When it is detected at step 124 that the 8 least significant digits of the count are all 0, the 8 most significant digits are tested for the digit combinations 0000 0000, 0100 0000 and 1000 0000 (by comparing in a logical AND operation at step 132 each of the digits with the corresponding digit in the combination 0011 1111). If the result is found at step 134 to be 0, indicating the presence of one of these three combinations, the 8-bit counter 68*a* is incremented by 1 at step 136, and the procedure then continues at step 122. If the result is 1, a similar logical AND operation (with the combination 0010 1111) is effected at step 138 to test for the combinations 0001 0000 and 0101 0000 in the 8 most significant digits. If the result is found at step 140 to equal 0, the 8-bit counter 68*e* is incremented by 1 at step 142, and the procedure continues at step 122, as it does if the result at step 140 is 1.

The effect of the steps 132 to 142 is to increment the counters 68*a* and 68*e* three times and twice a minute respectively, at different times and after successively different intervals. Thus, the counter 68*a* is incremented at 0, 455 milliseconds and 910 milliseconds after the counter 66 is reset at step 128, and the counter 68*e* is incremented at 114 milliseconds and 569 milliseconds after that operation.

Consequently the counts in the counters 68 vary in a stepwise linear manner with time, at different rates, the intervals between successive steps being of unequal duration. The full-house counts of the counters 68*a* and 68*e* are 199 and 255, so it takes them respectively 67 and 128 minutes to step through from zero to full-house count. Furthermore, the counters 68 are bidirectional, and arranged to count back down after they reach full-house: thus the counters 68*a* and 68*e* have total cycle times of 134 and 256 minutes.

When the main gun 3 is 'fired', the sequence controller 54 detects this at step 130 and then proceeds at step 144 to cause the scan controller 50 to supply appropriate numbers of energising pulses to the stepping motors 36 and 46 and move the projector 2 through the required reverse offsets, as described earlier, thereby to orientate the centre of scan of the lasers to the beam datum direction corresponding to optimum aim.

At step 146, the store 72 derives from a look-up table a scaling factor related to the range previously measured by the range circuit 52, and the counts in the counters 68*a* and 68*e* are each multiplied by this factor in the multipliers 70*a* and 70*e* at step 148. This scaling provides simulation of the increase in dispersion of fall of shot with range.

To provide both negative and positive values, the binary number 0111 1111 is subtracted at step 150 from the scaled counts generated by the multipliers 70*a* and 70*e* to derive respective 8-bit binary numbers which define numbers of energising pulses to be supplied by the scan controller 50 at step 152 to the stepping motors 46 and 36 respectively. These additional pulses displace the centre of scan of the laser beams from the optimum beam datum direction.

Thereafter, further pulses are supplied to the stepping motors 36 and 46 by the scan controller 50 at step 154 to scan the laser beams around the displaced centre of scan, and the hit/miss indicator monitors for and indicates a hit or a miss as appropriate. The procedure then returns to step 120.

The perturbation of the laser scan introduced at step 152 varies only slowly. Thus the tank crew can estimate and apply a correction to the aiming of the gun after the first of a series of shots, and, provided there is little delay before the following shots, the perturbation will remain largely compensated by the correction and a hit will be obtained. However, after several minutes have elapsed, the perturbation will have changed significantly, so that the same correction, or a simple optimum aiming of the gun, may not result in the projector 2 being oriented towards the target when scanning takes place. Then a miss will be registered, simulating the ranging shots that are sometimes necessary in a new battle engagement, or the effects of changing to a new batch of shells. It will be noted that the cycle time of the counters 68 is a non-integral number of hours, to reduce the possibility of crew members recognising the cycle and applying compensatory cyclic corrections.

Although the apparatus shown in FIGS. 4 and 6 has been depicted in block diagram form, the functions shown in FIGS. 5 and 7 may equally be implemented in an appropriately-programmed digital computer. In this case, for example, the period t may be the interval between successive regular interrupts in the computer's routine of operation.

Although the system described above has the detector 5 mounted on the target 4, as shown in FIG. 1, it is to be understood that the invention is equally applicable to systems in which the detector 5 is carried with the projector 2 by the attacker 1, radiation incident upon the target 4 being returned to the detector 5 by a retro-reflector carried by the target 4. Furthermore, depending on the particular design of the projector 2, the scanning of the laser beams might involve movement of only part of the laser source rather than of the source in its entirety as described above.

We claim:

1. A method of incorporating a probability factor in an assessment of the accuracy of aim of a weapon, comprising the steps of:

generating a variable whose value changes with time at a rate related to a characteristic of ammunition the use of which is to be simulated by varying through a range including the minimum and maximum values of the probability factor in a pseudo-random manner relative to the time interval between successive aimings of the weapon;

determining whether the weapon has been substantially optimally aimed in relation to a target; and modifying each assessment of accuracy in accordance with the current value of said variable, including the steps of:

comparing the value of said variable with said probability factor; and assessing the aim as being accurate only if the weapon has been substantially optimally aimed and said value is less than said factor.

2. A method according to claim 1, wherein the value of said probability factor for comparison with the value of said variable is selected in dependence upon the type and range of the target.

3. A method according to claim 1 or claim 2, wherein the variable is generated by incrementing and decrementing a counter at intervals much less than the interval between successive aimings of the weapon, the amount of each decrement being a nonintegral multiple of the amount of each increment.

4. A method of incorporating a probability factor in an assessment of the accuracy of aim of a weapon, wherein said assessment involves scanning a beam of electromagnetic radiation about a datum direction corresponding to optimum aim, comprising the steps of:

generating a variable whose value changes at a rate related to a characteristic of ammunition the use of which is to be simulated by varying gradually with time; and modifying each assessment of accuracy by displacing the orientation of said beam from said datum direction in accordance with the current value of the variable before said scanning is effected.

5. A method according to claim 4, wherein the variable varies in a manner that is step wise linear with time, successive intervals between steps being unequal.

6. A method according to claim 5, including the step of incrementing a counter up to a predetermined full-house count, and varying the variable by a fixed amount when said count reaches predetermined trigger values which sub-divide the full-house count unequally.

7. A method according to claim 4, wherein the variable is generated as a vector by generating orthogonal components thereof which vary at different rates.

8. A method according to claim 4, wherein the variable varies cyclically over a period which is long in relation to the interval between successive aimings of the weapon.

9. A method according to claim 8, wherein the period between successive changes in said variable is of the same order of magnitude as the interval between successive aimings of the weapon.

10. A method according to claim 4, wherein the displacement of the orientation of said beam is related to the value of the variable by the range of the target.

11. A weapon training system for incorporating a probability factor in an assessment of the accuracy of aim of a weapon, comprising:

means arranged to generate a variable whose value changes with time at a rate related to a characteristic of ammunition the use of which is to be simulated by varying through a range including the minimum and maximum values of the probability factor in a pseudo-random manner relative to the time interval between successive aimings of the weapon;

means arranged to determine whether the weapon has been substantially optimally aimed in relation to a target; and means arranged to modify each assessment of accuracy in accordance with the current value of said variable, said modifying means being arranged to compare the value of said variable with said probability factor such that the aim is assessed as being accurate only if the weapon has been substantially optimally aimed and said value is less than said factor.

12. A system according to claim 11, wherein the modifying means is arranged to select the value of said probability factor for comparison with the value of said variable in dependence upon the type and range of the target.

13. A system according to claim 11 or claim 12, wherein said generating means is arranged to increment and decrement a counter at intervals much less than the interval between successive aimings of the weapon, the amount of each decrement being a non-integral multiple of the amount of each increment.

14. A weapon training system for incorporating a probability factor in an assessment of the accuracy of aim of a weapon, including means for scanning a beam of electromagnetic radiation about a datum direction corresponding to optimum aim comprising:

means arranged to generate a variable whose value changes at a rate related to a characteristic of ammunition the use of which is to be simulated by varying gradually with time, and modifying means responsive to the generating means and arranged to modify each assessment of accuracy by causing the scanning means to displace the orientation of said beam from said datum direction in accordance with the current value of the variable before said scanning is effected.

15. A system according to claim 14, wherein the value of said variable varies in a manner that is stepwise linear with time, successive intervals between steps being unequal.

16. A system according to claim 15, wherein said generating means is arranged to increment a counter up to a predetermined full-house count, and vary the variable by a fixed amount when said count reaches predetermined trigger values which sub-divide the full-house count unequally.

17. A system according to claim 14, wherein said generating means is arranged to generate the variable as a vector by generating orthogonal components thereof which vary at different rates.

18. A system according to claim 14, wherein the variable varies cyclically over a period which is long in relation to the interval between successive aimings of the weapon.

19. A system according to claim 18, wherein the period between successive changes in said variable is of the same order of magnitude as the interval between successive aimings of the weapon.

20. A system according to claim 14, wherein the displacement of the orientation of said beam is related to the value of the variable by the range of the target.

* * * * *